United States Patent [19]

Kunogi

[11] Patent Number: 4,565,219

[45] Date of Patent: Jan. 21, 1986

[54] MULTIPLE-POSITION SOLENOID-OPERATED CONTROL VALVE

[75] Inventor: Mahito Kunogi, Nagoya, Japan

[73] Assignee: The Oilgear Japan Company, Aichi, Japan

[21] Appl. No.: 528,634

[22] Filed: Sep. 1, 1983

[30] Foreign Application Priority Data

Sep. 13, 1982 [JP] Japan ..... 57-159362
May 11, 1983 [JP] Japan ..... 58-82162

[51] Int. Cl.[4] ..... F15B 13/044

[52] U.S. Cl. ..... 137/625.65; 137/624.18; 251/129.10

[58] Field of Search ..... 137/624.18, 625.65; 251/120, 129, 137, 337

[56] References Cited

U.S. PATENT DOCUMENTS

| | | | |
|---|---|---|---|
| 2,436,992 | 3/1948 | Ernst | 137/625.65 X |
| 2,910,089 | 10/1959 | Yarber | 137/625.65 |
| 3,967,648 | 7/1976 | Tirelli | 137/625.65 |
| 4,194,719 | 3/1980 | Ewald et al. | 137/625.64 X |
| 4,342,443 | 8/1982 | Wakeman | 251/137 |
| 4,422,475 | 12/1983 | Aspinwall | 251/137 X |

*Primary Examiner*—Gerald A. Michalsky

*Attorney, Agent, or Firm*—Parkhurst & Oliff

[57] ABSTRACT

A multiple-position solenoid-operated control valve having a valving member in the form of a spool fitted in a valve body so that it is normally held at its normal position by a first spring and slidably movable at least to two or more operated positions on one side of the normal position. The spool is moved by a movable iron core upon energization of a solenoid which produces actuating forces of different magnitudes increasing in at least two steps including a first operating force to move the spool to the first operated position against a first biasing force of the first spring, and a second operating force greater than the first operating force. At least a second spring is provided to cooperate with the first spring to hold the spool at the first operated position against the first operating force until the second operating force is produced. The second spring producing a second biasing force which is greater than a difference between the first operating force and the first biasing force and smaller than a difference between the second operating force and the first biasing force. The valve may comprise an adjusting mechanism for changing the first operated position of the spool with respect to its normal position.

24 Claims, 10 Drawing Figures

MULTIPLE-POSITION SOLENOID-OPERATED CONTROL VALVE

BACKGROUND OF THE INVENTION

The present invention relates in general to a solenoid-operated control valve, and more particularly to a multiple-positioned solenoid-operated control valve wherein a valving member such as a valve spool is located at a plurality of operated positions thereof at least on one side of its normal or neutral position.

As solenoid control valves, there have been used directional control valves, flow control or throttling valves or restrictors, shutoff valves, and so on, wherein a valving member as in the form of a spool or piston axially slidably fitted in a valve body having a plurality of ports is normally held in its normal, neutral or original position by a spring, and moved to its operated position or positions against a biasing or resilient force of the spring by means of a solenoid-operated actuator including a movable iron core and a solenoid coil, thereby changing communicating conditions between the ports and associated flow passages, i.e., changing a flow direction of a working fluid, and its flow rate, i.e., cross sectional area of the passage opening at each port. For example, a directional control valve the valve spool of which is selectively located at two or three positions is referred to as a two- or three-position control valve. In the three-position control valve, the valve spool is normally spring-centered at its neutral position and displaced to the right or left of the neutral position, upon energization of one of two solenoids disposed on both sides of the valve spool, to control communicating conditions of the appropriate ports. In the two-position control valve, on the other hand, the valve spool which is biased in one axial direction thereof by a spring and therefore normally held in its normal or original position, is displaced in the other axial direction upon energization of a solenoid to control the communicating conditions of the ports. A flow control or shutoff valve has a valving or orifice control member which is normally held in its normal position by a spring and which is displaced upon actuation of a solenoid for progressively varying or controlling in steps the volume of fluid that passes through a passage or passages or for closing and opening the passage of the fluid.

In the solenoid-operated control valve known in the art, a valving member has on one or each side thereof only one operated position to which it is displaced when the appropriate solenoid is energized. Although there has been known a manually-operated directional control valve which has five positions, i.e, two operated positions on each side of the neutral or center positon of a valve spool, no known solenoid-operated control valves have a valve spool or other valving member which has plural operated positions on one side of its normal position. In this connection, a solenoid-operated proportioning valve is known wherein a valve spool or piston is controlled to be located at a selected position within a predetermined range of its operating stroke. However, this proportioning type of solenoid-operated control valve requires a complicated operation control circuit, which consequently results in pushing up the cost of a hydraulic or pneumatic circuit in which the control valve is incorporated.

SUMMARY OF THE INVENTION

It is accordingly an object of the present invention to provide a multiple-position solenoid-operated control valve wherein a valving member has two or more operated positions at least on one side thereof.

Another object of the invention is to provide such type of solenoid-operated valve wherein a first one of the plural operated positions is adjustable.

According to the invention, there is provided a multiple-position solenoid-operated control valve which comprises: a valve body formed with a plurality of ports; a valving member fitted in the valve body axially movably to change communicating conditions of the ports; resilient means including first biasing means for normally holding said valving member in a normal position thereof with a first biasing force; and electromagnetic actuating means including a solenoid, an electric power circuit to energize the solenoid, and a movable iron core axially movable toward one end of the valving member to move the same upon energization of said solenoid. The electromagnetic actuating means produces actuating forces of different magnitudes increasing in at least two steps, including a first operating force to move said valving member from the normal position to a first operated position thereof against the first biasing force of the first biasing means, and a second operating force greater than the first operating force. The resilient means further includes second biasing means which cooperates with the first biasing means to hold the valving member at the first operated position against the first operating force of the electromagnetic actuating means until the second operating force is produced. The second biasing means produces a second biasing force which is greater than a difference between the first operating force and the first biasing force and smaller than a difference between said second operating force and said first biasing force. Therefore, the valving member is moved to a second operated position upon application of the second operating force to the movable iron core.

In accordance with the subject matter of the present invention, a multiple-position control valve having plural operated positions on one side of its normal or neutral position, which has been operated manually in the art, can be automatically operated through energization of a solenoid. As a result, a single multiple-position solenoid-operated control valve according to the invention is capable of functioning in place of two solenoid-operated control valves used in a known hydraulic or pneumatic circuit. Thus, the use of the multiple-position control valve constructed according to the invention will simplify a fluid-operated system incorporating such fluid circuit.

In one form of the invention, the multiple-position solenoid-operated control valve may comprise a plunger which is biased by the second biasing means in a direction toward the movable iron core and normally held in an original position thereof with the second biasing force. This plunger is operatively connected to the movable iron core after a predetermined distance of movement of the latter with the first operating force against the first biasing force and thereafter moved from the original position together with the movable iron core with the second operating force against a sum of the first and second biasing forces until the valving member has been moved to the second operated position.

In the above form of the control valve, the movable iron core is moved, upon energizaton of the solenoid, to push the valving member to the first operated position, i.e., until the movable iron core is operatively connected to the plunger or brought into direct or indirect abutment on the plunger. When the second operating force is produced by the electromagnetic actuating means, the movable iron core moves the plunger, against the second biasing force of the second biasing means, together with the valving member until the valving member is moved to its second operated position. In this arrangement, for example, the plural ports of the valve are placed in communication so that the volume of fluid that passes the valve is restricted when the valving member is located at its first operated position, but the ports are fully communicated with each other without any restriction of the fluid flow through the valve when the valving member is located at its second operated position.

According to a preferred form of the invention, the control valve comprises an adjusting mechanism for changing the original position of the plunger relative to the normal position of the valving member axially of the plunger and the valving member. In this arrangement, it is possible to adjust the first operated position of the valving member and therefore compensate for or absorb possible dimensional errors of components of the valve during manufacture thereof. In other words, no strict control of the dimensional accuracy of the component parts of a valve is required in order to assure an accurate setting of the first operated position of the valving member. This means a high accuracy of flow control of the fluid at the first operated position of the valving member if this position is used to restrict the fluid flow. Further, the adjusting mechanism permits adjustment in degree of restriction of the fluid flow, thereby enabling the control valve to serve as a variable-restriction throttling valve.

BRIEF DESCRIPTION OF THE DRAWINGS

Other objects and advantages of the present invention will be readily appreciated by reference to the following detailed description when considered in connection with the accompanying drawings in which.

DETAILED DESCRIPTION OF THE PREFERRED EMBODIMENTS

Referring now to the accompanying drawings, preferred embodiments of the present invention will be described in detail in connection with solenoid-operated directional control valves by way of example.

Figure 1:
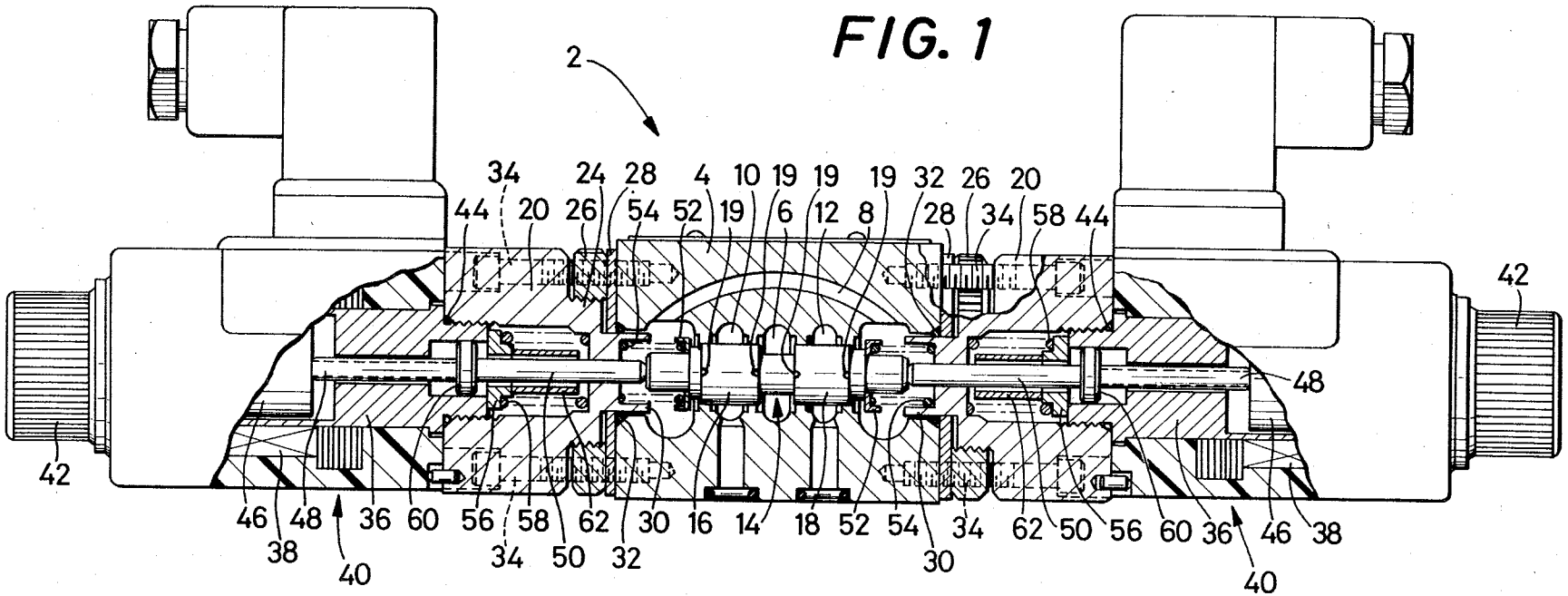
FIG. 1 is a front elevation in partial cross section of one embodiment of a multiple-position solenoid-operated directional control valve of the present invention.
Figure 2:
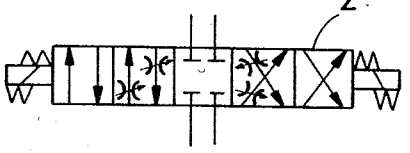
FIG. 2 is a schematic diagram graphically representing the directional control valve of FIG. 1.

There is shown in FIG. 1 a five-position four-way (four-port) closed-center directional control valve 2 as represented by a schematic diagram of FIG. 2. Reference numeral 4 in FIG. 1 designates a valve body which is formed with a through-bore in which a valve spool designed as a valving member is fitted, and further provided with four ports; a pressure port (inlet port) 6 connected to a power source such as a pump, a tank port (exhaust port) 8 connected to a reservoir, and A- and B-ports 10 and 12 designed as actuating ports (normally referred to as cylinder ports) connected to respective ports of fluid-operated units such as hydraulic cylinders. The valve spool indicated at 14 is disposed axially slidably such that it extends adjacent the above indicated ports. The valve spool 14 is provided with two axially spaced-apart lands 16 and 18 which are adapted to close all of the ports when the spool 14 is located at its normal or neutral (center) position. Each of the lands 16, 18 is provided with a cut-out 19 at its peripheral surface at opposite ends thereof.

To the left-hand side end of the valve body 4, there is fixed a housing 20 which is provided with a through-bore concentric with the through-bore of the valve body 4 in which the valve spool 14 is slidably fitted. The housing 20 is further provided, at one end thereof closest to the valve body 4, with an annular projection 24 having on its outer peripheral surface an external thread which engages an annular internally threaded member 26 such that the outer end face of the threaded member 26 protrudes a given distance from the end face of the projection 24 toward the valve body 4 and abuts on the end face of the valve body 4 via a washer 28. The annular projection 24 has an engaging protrusion 30 which extends from the end face of the projection 24 so as to engage the through-bore of the valve body 4, whereby the housing 20 and the valve body 4 are positioned in a concentric relation with each other. An O-ring 32 is provided to maintain fluid tightness between the housing 20 and the valve body 4. The housing 20 is of square shape in transverse cross section while the internally threaded member 26 has a circular cross sectional shape. The housing 20 has four bolt holes at its four corner portions outside the outer circumference of the threaded member 26. Corresponding four fixing bolts 34 are inserted through these bolt holes and threaded to the valve body 4, thereby fastening the housing 20 to the valve body 4 with the threaded member 26 interposed therebetween. In this arrangement, therefore, turning the threaded member 26 by a desired angle with the bolts 34 loosened will allow a required adjustment in relative axial position of the housing 20 with respect to the valve body 4. Thus, a connecting mechanism consisting of the annular projection 24, threaded member 26 and bolts 34 also serves as a position adjusting mechanism which will be described in more detail.

To the other end of the housing 20 remote from the valve body 4, is threaded a cylindrical solenoid tube 36 such that it is concentric with the valve spool 14. The outer peripheral surface of this solenoid tube 36 engages an externally located tubular body 40 comprising a solenoid 38 which is supported and protected by a synthetic resin material. The tubular body 40 is fastened to the valve body 4 by an internally threaded member 42 which is threaded to the distal end of the solenoid tube 36 (See FIGS. 9 and 10.). An O-ring 44 is provided to maintain fluid tightness between the solenoid tube 36 and the housing 20.

The solenoid tube 36 accommodates a movable iron core 46 and a solenoid pin 48 which are slidable axially of the tube 36. A relay pin 50 is axially movably disposed in the housing 20 so that the pin 50 is concentric with the solenoid pin 48 and the valve spool 14. Thus, the movable iron core 46 which is abuttable on the solenoid pin 48, is abuttable on the relay pin 50 which is abuttable on the valve spool 14. With this construction, a rightward movement (as viewed in FIG. 1) of the movable iron core 46 with a magnetic operating force upon energization of the solenoid 38 is transmitted to the valve spool 14 via the solenoid and relay pins 48 and 50, and as a result the valve spool 14 is pushed to the right. A spring 54 is disposed with a predetermined magnitude of preload between the end face of the housing 20 and an annular spring seat 52 which engages one end portion of the valve spool 14 and bears against a shoulder face of the spool 14, so that the spring 54 provided as first biasing means prevents the spool 14 from being displaced leftwardly from its neutral position while the solenoid 38 is not energized. The relay pin 50 slidably extends through an annular plunger 56 which is biased by a spring 58 disposed between the plunger 56 and the housing 20. This spring 58 designed as second biasing means is provided with a predetermined magnitude of preload greater than the preload applied to the spring 54, whereby the plunger 56 is normally forced against the end face of the solenoid tube 36, i.e., normally held at its original position by the spring 58. The relay pin 50 has, at one end thereof projecting toward the solenoid pin 48, a head portion 60 of a large diameter which is adapted such that it is spaced a given distance from the end of the plunger 56 when the other end of the relay pin 50 is in abutment on the valve spool 14 located at its neutral position. Upon a rightward advancement of the movable iron core 46 and the consequent advancing movements of the solenoid pin 48 and the relay pin 50, the head portion 60 abuts on the end face of the plunger 56 for pushing the plunger 56 against a biasing force of the spring 58. Thus, the plunger 56 is operatively connected to the movable iron core after a predetermined distance of the movable iron core 46. The advancing distance of the plunger 56 is limited by a sleeve 62 which fits on a portion of the relay pin 50 adjacent to the plunger 56 and which is movable together with the plunger 56 until it is stopped by the housing 20.

While the construction of the directional control valve 2 on the left-hand side of the valve body 4 has been described, the right-hand side of the valve 2 has the completely same construction as the left hand side. For convenience, therefore, the same reference characters are used to identify corresponding parts on the right-hand side of the valve 2 and their detailed description is omitted.

Figure 3:
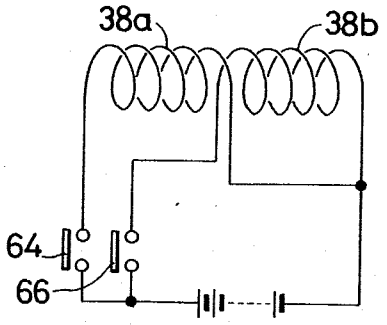
FIG. 3 is a diagram of an electric circuit of the control valve of FIG. 1.

As represented in FIG. 3, the solenoid 38 comprises two coil windings 38*a* and 38*b* which are energized upon closure of respective contacts 64 and 66.

Figure 4:
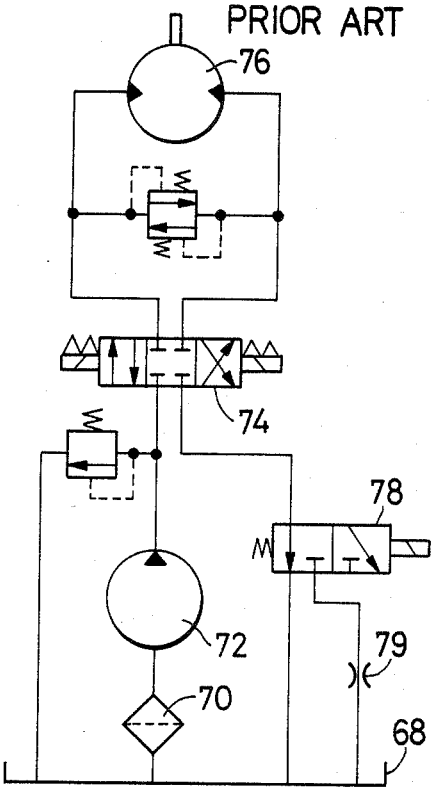
FIG. 4 PRIOR ART
FIG. 4 is a diagram of an exemplary hydraulic circuit incorporating a solenoid-operated directional control valve known in the art.
Figure 5:
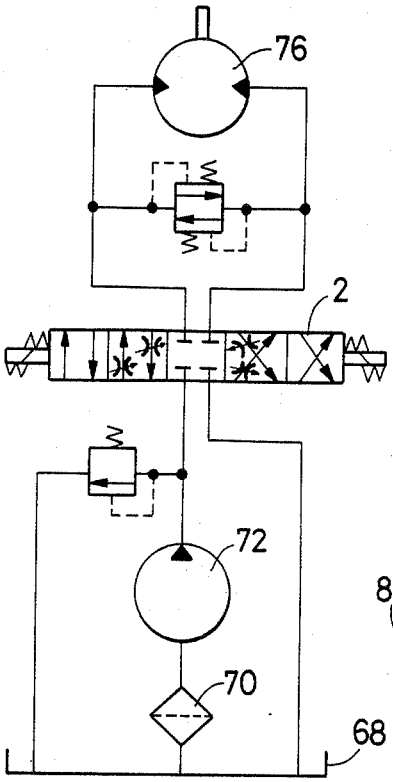
FIG. 5 is a diagram of a hydraulic circuit incorporating the directional control valve of the invention of FIG. 1 and serving the same function as the hydraulic circuit of FIG. 4.

By utilizing the directional control valve 2 constructed as depicted hereinbefore, a hydraulic circuit with a known arrangement as shown in FIG. 4 may be advantageously modified as shown in FIG. 5. More specifically stated referring first to FIG. 4, a working fluid pumped up by a pump 72 from a reservoir 68 through a filter 70 is delivered to a hydraulic motor 76 via a three-position four-way directional control valve 74 in order to actuate the hydraulic motor 76. This arrangement requires the working fluid exhausted from the hydraulic motor 76 to be returned to the reservoir 68 not only through the directional control valve 74 but also a two-position three-way directional control valve 78, so that a flow of the exhaust fluid from the hydraulic motor 76 is restricted by a choke or restrictor (throttling valve) 79 with the control valve 78 set in its right position (in FIG. 4) for certain short periods of time immediately after the movement of a spool of the control valve 74 from its neutral position to its right or left position, and immediately before the return movement of that spool to the neutral position. As a result, the hydraulic motor 76 is started and stopped with smooth acceleration and deceleration which lead to protect a unit operated by the hydraulic motor 76 against otherwise possible shocks or impacts at the time of start and stop of the unit, and which futher assure an accurate control of a position at which the unit is stopped. It is recognized, however, that the arrangement of FIG. 4 requires another directional control valve, i.e., control valve 78 in addition to the directional control valve 74, and also requires the restrictor or throttling valve 79. These additional components necessarily require additional connection lines and related fittings as well as additional electrical circuits, thereby creating various inconveniences and disadvantages such as increased cost, complicated asssembling and increased required space for installation of the system, and increased possibility of leakage of the working fluid.

Unlike the above discussed known arrangment of the hydraulic circuit, a hydraulic circuit using the five-position four-way directional control valve 76 of the invention does not need any further directional control valve other than the valve 76 and therefore has no conventionally experienced problems as discussed previously. More precisely described, the closure of the contact 64 shown in FIG. 3 will energize one of the coil windings 38*a* of the solenoid 38, and thereby cause the movable iron core 46 to be displaced to the right with a magnetic force produced upon energization of the first coil winding 38*a*. As a result, the movable iron core 46 will push the valve spool 14 to the right via the solenoid pin 48 and the relay pin 50, whereby the valve spool 14 is displaced against the biasing force of the right-hand side spring 54. In consequence, the tank port 8 and the pressure port 6 are connected to the A-port 10 and the B-port 12, respectively, through the cutouts 19 formed at the end portions of each land 16, 18. In the meantime, the head portion 60 of the relay pin 50 is brought into abutment on the end face of the plunger 56. In this connection, it is noted that the magnetic force applied to the movable iron core 46 by energizaton of the first coil winding 38*a* is greater than the biasing force of the spring 54 and consequently permits the valve spool 14 to be rightwardly moved against the biasing force of the spring 54. However, a magnitude of the said magnetic force is so selected that the plunger 56 and the spool 14 may not be moved to the right against a sum of the biasing forces of the first and second springs 54 and 58. Therefore, the rightward movements of the movable iron core 46, solenoid and relay pins 48 and 50 and valve spool 14 are stopped at the moment of the abutment of the head porton 60 on the plunger 56. For convenience of explanation, the position of the valve spool 14 upon the above abutment of the head portion 60 is hereinafter referred to as a "first operated position" and the magnetic force of the movable iron core 46 produced by the first coil winding 38*a* as a "first operating force". In the above condition, the appropriate pairs of the ports are placed in communication through the cut-outs 19 as previously exlained, and consequently a pressurized fluid from the pump 72 of FIG. 5 is fed to the hydraulic motor 76 after the fluid flow is restricted through the cut-outs 19 of the land 18 of the valve spool 14. The fluid exhausted from the hydraulic motor 76 passes the control valve 2 through the A-port 10, cut-outs 19 of the land 16 and tank port 8, whereby the flow of the exhaust fluid is restricted by the cut-outs 19 before the fluid is returned to the reservoir 67. Thus, in the hydraulic circuit using the control valve 2 of the invention, the flow of the fluid delivered to the hydraulic motor 76 as well as the flow of the fluid exhausted from the motor 76 are restricted, so that both metering-in and metering-out controls are achieved within the hydraulic system. However, only one of the metering-in and metering-out controls may be accomplished by means of shortening the width of the land 16 or 18.

A short time after the hydraulic motor 76 has been started with a smooth motion as described above, the contact 66 shown in FIG. 3 is closed and the second coil winding 38*b* of the solenoid 38 is also energized so that the magnetic force to move the movable iron core 46 is increased. It is noted that this increased magnetic force referred to as a "second operating force" is greater than the combined resilient force of the two springs 54 and 58. Therefore, the movable iron core 46 is further moved to the right while pushing the plunger 56 until the plunger is stopped with the sleeve 62 abutting on the housing 20. In this stopped condition, the valve spool 14 is located at a second operated position at which the A- and B-ports 10 and 12 are held in communication with the tank and pressure ports 8 and 6, respectively, through passages of a sufficient cross sectional area at the communication points, that is, the substantially entire amount of fluid as delivered by the pump 72 is freely supplied to the hydraulic motor 76 with a result of operation of the motor 76 at a high speed.

When the unit operated by the hydraulic motor 76 has been actuated to a position near its operating end, the contact 66 of FIG. 3 is opened and the solenoid coil winding 38*b* is deenergized, and the magnetic force applied to the movable iron core 46 is reduced to the first operating force which is smaller than the sum of the biasing forces of the two springs 54 and 58, whereby the plunger 56 is restored to its original position while pushing the movable iron core 46. At the same time, the valve spool 14 is returned to its first operated position and the flow of the fluid is again restricted with a result of a decrease in the operating speed of the hydraulic motor 76.

The hydraulic motor 76 is kept operated in the above condition for a given short length of time, and then the contact 64 is also opened to deenergize the first coil winding 38*a*, i.e., a power supply to the solenoid 38 is completely removed. Consequently, the valve spool 14 is returned to its neutral position with the resilient force of the spring 54 and the supply of the fluid to the hydraulic motor 76 is shut off to stop the operation of the hydraulic motor 76.

While the foregoing description has been concerned with the rightward movement of the valve spool 14 to a third and a fourth operated position upon energization of the solenoid, the same description applied to a leftward movement of the valve spool 14 by the solenoid. In this instance, the hydraulic motor 76 is smoothly started in the reverse direction and after a short time interval its operating speed is increased, and then the speed is reduced for smooth stop of the motor.

As is apparent from the foregoing description, the present embodiment of the directional control valve 2 of the invention is a development of a three-position directional control valve into a five-position directional control valve by simply adding two pairs of the plungers 56 and springs 58 and making minor modifications to an electric circuit including the solenoid 38, for obtaining restriction or choking of a fluid flow at two positions of the total five positions.

A further advantage of the present embodiment is its capability of adjusting relative axial position of the housing 20 and the valve body 4 by changing a depth of thread-coupling of the internally threaded member 26 with respect to the annular projection 24 of the housing 20. With this capability, it is possible to adjust the original position of the plunger 56 and the neutral or normal position of the valve spool 14 relative to each other, i.e., to adjust the first operated position of the valve spool 14 upon indirect abutment or operative connection of the movable iron core 46 on or to the plunger 56 through the solenoid pin 48 and the head portion 60 of the relay pin 50. The connecting mechanism 35 including the projection 24, internally threaded member 26 and fixing bolts 34, therefore, may compensate for or absorb possible dimensional errors in the manufacture of the valve body 4, spool 15, relay pin 50, housing 20, sleeve 62, plunger 56, and other parts, thereby enabling the valve spool 14 to be placed exactly at its first operated position and permitting an intended restriction of fluid flow without a strict control of the dimensions of the component parts.

It is further noted that the change in coupling position of the threaded member relative to the projection 24, which allows adjustment of the first operated position of the valve spool 14, means the capability of adjusting as needed a degree of fluid flow restriction or throttling at the first operated position. In this sense, it is considered that the valve body 4 and the valve spool 14 in this particular embodiment constitute a variable-restriction throttling valve.

Although a change of the first operated position of the spool 14 by changing the coupling position of the threaded member 26 and the projection 24 results in a change of the second operated position of the spool 14 as well, the latter change will not affect the fluid flow to an appreciable extent because the communication between the appropriate ports at the second operated position of the spool 14 is attained through flow passages having a sufficiently large cross sectional area.

While the present embodiment of the directional control valve 2 is adapted to restrict the fluid flow when the valve spool 14 is held in its first operated position, it will be obvious to increase the number of ports in the valve body 4 for effecting a more complicated control of direction and flow of a working fluid, for example, by changing conditions of communications between the appropriate ports at first and second positions of the spool 14. Further, it is possible to provide three or more operated positions on each side of the normal or neutral position of a spool. It is also possible to provide plural operated positions only on one side of the normal or neutral position of the spool by using second biasing means including two or more springs corresponding to the plural operated positions.

Figure 6:
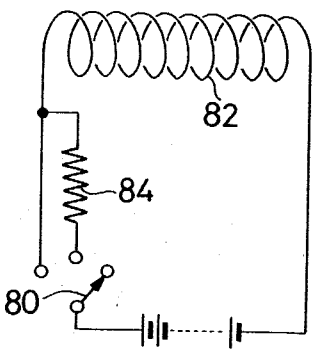
FIGS. 6 through 8 are diagrams of alternative electric circuits usable in place of the circuit of FIG. 3 in other embodiments of the invention.
Figure 8:
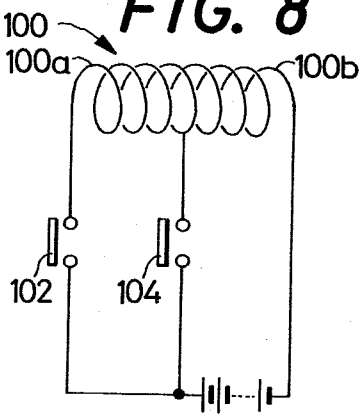
Figure 7:
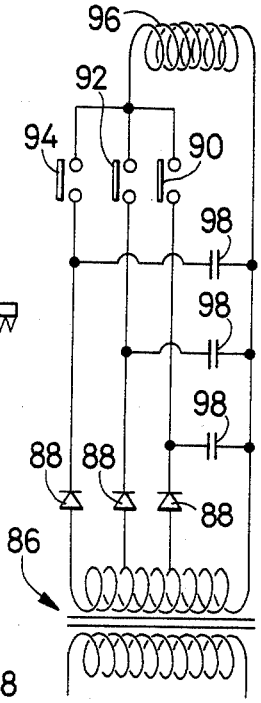

It is apparent that an electrical circuit for providing the movable iron core with operating or actuating forces of two or more different mangitudes, is by no means limited to the one shown in FIG. 3 used in the present embodiment. Alternative examples of such circuit are shown in FIGS. 6–8. The circuit represented in FIG. 6 comprises a selector switch 80, a solenoid 82 and a resistor 84. In this circuit, a power supply to the solenoid 82 is conducted either through the resistor 84 or bypassing the same according to the selected position of the switch 80, whereby a current flow through the solenoid 82 is varied in two steps. The circuit shown in FIG. 7 comprises a transformer 86 whose plural taps of a secondary winding are connected to contacts 90, 92, 94 through diodes 88. A selective closure of these contacts will vary in steps a magnitude of voltage applied to the solenoid 96. Numerals 98 designate smoothing condensers. The circuit illustrated in FIG. 8 comprises a solenoid 100 consisting of a thick coil winding 100*a* and a thin coil winding 100*b*. By selective closure of contacts 102 and 104, the number of turns of the winding to be energized and consequently the electromagnetic force are varied in two steps while the current flow is not appreciably varied. Thus, the operating force to move the movable iron core is varied by changing a product of the number of turns of the solenoid winding multiplied by an amperage of a current applied to the wnding. It is of course allowable to apply an alternating current to the solenoid to energize the same.

Figure 9:
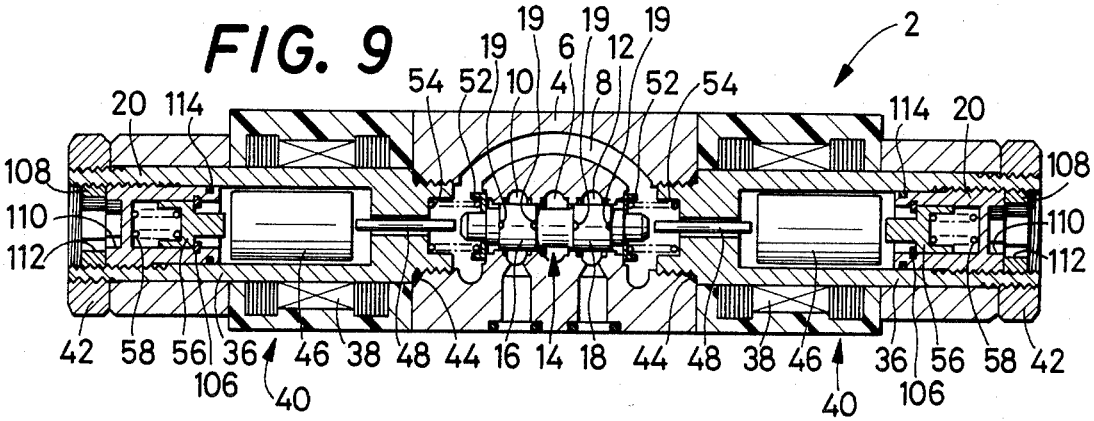
FIGS. 9 and 10 are front elevations in cross section of further embodiments of the multiple-position solenoid-operated control valve of the invention.

Referring next to FIG. 9, there is illustrated another embodiment of a control valve which is different from the previous embodiment mainly in the locations of the plungers 56 and the springs 58. Stated in more detail, while each plunger 56 in the previous embodiment is located between the movable iron core 46 and the valve spool 14, the plunger of this embodiment is located behind the movable iron core 46, that is, the spool 14 is disposed between the plunger 56 and the movable iron core 46. In this arrangement, therefore, the right-hand side plunger 56 is operative to determine the first operated position of the valve spool 14 when the left-hand side movable iron core 46 is actuated, and vice versa. In other words, one of the plungers 56 on one side of the valve spool 14 is provided in operative association with one of the solenoids 40 on the other side of the valve spool 14.

The plunger 56 is slidably housed in the cylindrical housing 20 having a bottom wall, and biased by the spring 58 in a direction away from the housing 20 but its projecting distance from the housing is limited by a C-shaped retaining ring 106. The housing 20 is screwed to an internally threaded rear portion of the cylindrical solenoid tube 36, i.e., the housing 20 and the tube 36 have mutually engaging threads such that the housing 20 is movable relative to the tube 36 upon turning of the housing 20. The housing 20 is locked in position with a lock member 108. The housing 20 has, in its rear end face, a hexagon recess 110 which is engageable with a hexagon wrench key for adjusting the coupling position of the housing 20 relative to the solenoid tube 36. Thus, the cylindrical solenoid tube 36 supporting the housing 20 cooperates with the housing 20 to provide a mechanism to adjust the first operated position of the valve spool 14. The lock member 108 has a hexagon hole 112 which is larger than the hexagon recess 110. This hexagon hole 112 is used to tighten and loosen the lock member 108 with a hexagon wrench key. An O-ring 114 is provided to maintain fluid tightness between the housing 20 and the solenoid tube 36. Other parts of the control valve of this embodiment are substantially the same as in the previous embodiment. The same reference numberals are applied to the corresponding parts to indicate the identical functionality.

Figure 10:
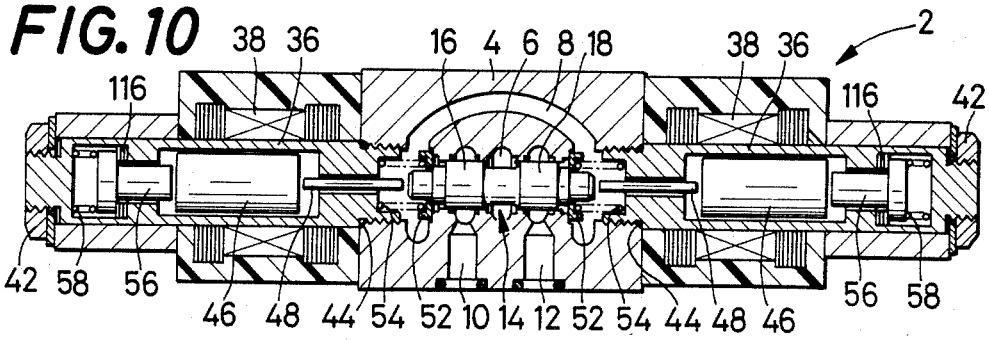

There is shown in FIG. 10 a further modified embodiment of the invention which is the same as the previus embodiment of FIG. 9, with the exception that the plunger 56 is directly housed in the cylindrical solenoid tube 36 and that the original position of the plunger 56 relative to the neutral position of the spool 14 is adjustable by changing the number and/or thickness of shims 116 which are interposed between the solenoid tube 36 and a head of the plunger 56. More particularly, the tube 36 has a bore in which the plunger 56 is biased by the spring 58 toward the movable iron core 46 but its movement with the biasing force is limited through abutment of its head on the the stack of the superposed shims 116 also disposed in the bore. Thus, the original position of the plunger 56 is determined by the specific number and/or thickness of the shims 116 interposed between the plunger head and the opposite wall of the solenoid tube 36.

While the foregoing embodiments of a control valve of the invention is of a so-called "wet" type wherein a working fluid enters the solenoid tube 36 and the movable iron core 46 is directly exposed to the working fluid, it is possible to apply the present invention to a control valve of a "dry" type wherein sealing means is provided to prevent such entry of the fluid, although the "wet" type is advantageous over the "dry" type in terms of ease of designing of the components associated with the solenoid tube, and low operational hysteresis of the valve due to friction of the moving components.

Further, the subject matter of the invention which has been described hereinbefore in connection with directional control valves for illustrative purpose only, may be embodied on a shutoff valve so that a fluid flow passage which is closed when a valve spool is held in its normal position is partially opened with a given degree of flow restriction when the valve spool is located at its first operated position, and wholly opened with the valve spool at its second operated position. A shutoff valve of this kind is capable of preventing a so-called "water hammer" phenomenon. It is apparent that the invention may be embodied in connection with a throttling valve or choke in order to provide a valve spool with multiple operated positions for restricting a fluid flow in steps.

It is to be understood to those skilled in the art that the invention may be embodied otherwise than as specifically described, with various modifications, changes and improvements made without departing from the spirit and scope of the invention defined in the appended claims.

What is claimed is:

1. A multiple-position solenoid-operated control valve, comprising:

a valve body having portions to define a plurality of ports;

a valving member fitted in said valve body axially slidably to change communicating conditions of said ports;

first biasing means for normally holding said valving member in a normal position thereof with a first biasing force;

a movable iron core axially movable in parallel to said valving member to move the same;

an electric circuit including a solenoid to apply to said movable iron core actuating forces of different magnitudes which increase in at least two steps including a first operating force to move said valving member from said normal position to a first operated position thereof against said first biasing force, and a second operating force greater than said first operating force;

a plunger normally held in an original position thereof and operatively connected to said movable iron core after a predetermined distance of movement of the latter by said first operating force against said first biasing force;

second biasing means for biasing said plunger with a second biasing force in a direction toward said movable iron core and holding the same at an original position thereof, said second biasing force being selected to be greater than a difference between said first operating force and said first biasing force and smaller than a difference between said second operating force and said first biasing force, said plunger being moved from said original position together with said movable iron core by said second operating force against a sum of said first and second biasing forces until said valving member has been moved to a second operated position thereof; and an adjusting mechanism for changing said original position of said plunger relative to said normal position of said valving member axially of said plunger and said valving member, said adjusting mechanism being operable to change said original position of said plunger without separating said movable iron core, said solenoid, said plunger and said second biasing means from said valve body.

2. A control valve as recited in claim 1, wherein said valving member is disposed between said plunger and said movable iron core, said plunger being operatively connected to said movable iron core through at least said valving member.

3. A control valve as recited in claim 2, further comprising another electromagnetic actuating means disposed opposite to the other end of said valving member and including another movable iron core axially movable toward said other end of said valving member upon energization of said another electromagnetic actuating means, said plunger being abuttable on said other end of the valving member through said another movable iron core.

4. A control valve as recited in claim 1, wherein said adjusting mechanism comprises a connecting mechanism which connects a housing supporting said plunger and said second biasing means to said valve body in such manner as to permit a change in axial relative position between said housing and said valve body.

5. A control valve as recited in claim 1, wherein one of said housing and said valve body includes an annular projection protruding from one axial end thereof concentrically with said plunger and having an external thread on its outer peripheral surface, said connecting mechanism comprising an internally threaded member engaging said annular projection and abutting at one end face thereof on the other one of said housing and said valve body, and a plurality of fixing bolts for fastening said housing to said valve body with said internally threaded member interposed therebetween.

6. A control valve as recited in claim 5, wherein said solenoid is supported by a tubular body which is located adjacent to said housing on one side thereof remote from said annular projection and concentrically with said annular projection, and said housing has a square transverse cross sectional shape while said internally threaded member has an annular transverse cross sectional shape, said housing having bolt holes at corner portions thereof outside outer circumferences of said annular internally threaded member and said tubular body, said fixing bolts extending through said bolt holes, respectively, and threaded into said valve body.

7. A control valve as recited in claim 1, wherein said valving member is disposed between said plunger and said movable iron core, said plunger being operatively connected to said movable iron core through at least said valving member, said adjusting mechanism comprising a connecting mechanism which connects a housing supporting said plunger and said second biasing means, to said valve body in such manner as to permit a change in axial relative position between said housing and said valve body.

8. A control valve as recited in claim 7, wherein said connecting mechanism comprises a cylindrical tube accommodating said housing, said cylindrical tube being concentric with said valve body and fixed at one end thereof to one end of said valve body corresponding to the other end of said valving member, said cylindrical tube and said housing having mutually engaging threads such that said housing is movable within said cylindrical tube upon turning of said housing.

9. A control valve as recited in claim 1, wherein said valve body and said valve member have control means for controlling directions of flow or a working fluid to and from the control valve at said first and second operated positions, for permitting the control valve to be partially open at said first operated position to restrict a flow of the fluid in at least one of said directions, and for permitting the control valve to be fully open at said second operated position.

10. A control valve as recited in claim 9, wherein said valving member is valve spool having two lands thereon spaced axially from each other, each of said two lands having a cut-out on its peripheral surface at each of opposite ends thereof, said control means comprising said plurality of ports and said two lands.

11. A control valve as recited in claim 9, wherein said first and second operated positions are provided on one side of said normal position of said valving member corresponding to the other end thereof remote from said one end thereof, a third and a fourth operated position being provided on the other side of said normal position to control the directions of flow of the working fluid such that each flow of the fluid through the control valve at said third and fourth operated positions is reversed with respect to each corresponding flow of the fluid at said first and second operated positions, the control valve being partially open at said third operated position and fully open at said fourth operated position.

12. A control valve as recited in claim 11, wherein said plurality of ports comprises four ports, two pairs of which are in partial communication with each other when said valving member is located at said first and third operated positions, and in full communication when said valving member is located at said second and fourth operated positions, whereby the control valve serves as a five-position closed-center four-way control valve.

13. A control valve as recited in claim 1, wherein said electromagnetic actuating means is operated through application of a direct current to said solenoid, and provides two different products of a number of turns of said solenoid to be energized and an amperage of said direct current, for producing said actuating forces of different magnitudes increasing in two steps.

14. A control valve as recited in claim 1, wherein said movable iron core is directly exposed to a working fluid.

15. A multiple-position solenoid-operated control valve, comprising:

a valve body having portions to define a plurality of ports;

a valving member fitted in said valve body axially slidably to change communicating conditions of said ports;

resilient means including first biasing means for normally holding said valving member in a normal position thereof with a first biasing force;

electromagnetic actuating means including a solenoid, an electric power circuit to energize said solenoid, and a movable iron core axially movable toward one end of said valving member to move the same upon energization of said solenoid, said electromagnetic actuating means producing actuating forces of different magnitudes increasing in at least two steps including a first operating force to move said valving member from said normal position to a first operated position thereof against said first biasing force, and a second operating force greater than said first operating force, said resilient means further including second biasing means cooperating with said first biasing means to hold said valving member at said first operated position against said first operating force of said electromagnetic actuating means until said second operating force is produced, said second biasing means producing a second biasing force which is greater than a difference between said first operating force and said first biasing force and smaller than a difference between said second operating force and said first biasing force, whereby said valving member is moved to a second operated position upon application of said second operating force to said movable iron core;

an annular member which is disposed between said movable iron core and said valving member, said annular member being biased by said second biasing means in a direction toward said movable iron core and normally held in an original position thereof by said second biasing force, said annular member being operatively connected to said movable iron core after a predetermined distance of movement of the latter by said first operating force against said first biasng force, and thereafter moved from said original position, together with said movable iron core, by said second operating force against a sum of said first and second biasing forces until said valving member has been moved to said second operated position; and a pin extending through said annular member to transmit the operating force of said actuating means from said movable iron core to said valving member.

16. A control valve as recited in claim 15, further comprising an adjusting mechanism for changing said original position of said annular member relative to said normal position of said valving member axially of said annular member and said valving member.

17. A control valve as recited in claim 15, wherein said valve body and said valving member have control means for controlling directions of flow of a working fluid to and from the control valve at said first and second operated positions, for permitting the control valve to be partially open at said first operated position to restrict a flow of the fluid in at least one of said directions, and for permitting the control valve to be fully open at said second operated position.

18. A control valve as recited in claim 17, wherein said valving member is a valve spool having two lands thereon spaced axially from each other, each of said two lands having a cut-out on its peripheral surface at each of opposite ends thereof, said control means comprising said plurality of ports and said two lands.

19. A control valve as recited in claim 17, wherein said first and second operated positions are provided on one side of said normal position of said valving member corresponding to the other end thereof remote from said one end thereof, a third and a fourth operated position being provided on the other side of said normal position to control the directions of flow of the working fluid such that each flow of the fluid through the control valve at said third and fourth operated positions is reversed with respect to each corresponding flow of the fluid at said first and second operated positions, the control valve being partially open at said third operated position and fully open at said fourth operated position.

20. A control valve as recited in claim 19, wherein said plurality of ports comprises four ports, two pairs of which are in partial communication with each other when said valving member is located at said first and third operated positions, and in full communication when said valving member is located at said second and fourth operated positions, whereby the control valve serves a five-positon closed-center four-way control valve.

21. A control valve as recited in claim 15, wherein said electromagnetic actuating means is operated through application of a direct current to said solenoid, and provides two different products of a number of turns of said solenoid to be energized and an amperage of said direct current, for producing said actuating forces of different magnitudes increasing in two steps.

22. A control valve as recited in claim 15, wherein said movable iron core is directly exposed to a working fluid.

23. A control valve as recited in claim 19, further comprising an adjusting mechanism having a connecting mechanism which connects a housing supporting said annular member and said second biasing means to said valve body in such manner as to permit a change in axial relative position between said housing and said valve body.

24. A control valve as recited in claim 23, wherein one of said housing and said valve body includes an annular projection protruding from one axial end thereof concentrically with said annular member and having an external thread on its outer peripheral surface, said connecting mechanism comprising an internally threaded member engaging said annular projection and abutting at one end face thereof on the other one of said housing and said valve body, and a plurality of fixing bolts for fastening said housing to said valve body with said internally threaded member interposed therebetween.

* * * * *